US010335339B1

(12) United States Patent
Stees

(10) Patent No.: US 10,335,339 B1
(45) Date of Patent: Jul. 2, 2019

(54) PORTABLE EXAMINATION CHAIR

(71) Applicant: Susan Stees, Dunnellon, FL (US)

(72) Inventor: Susan Stees, Dunnellon, FL (US)

( * ) Notice: Subject to any disclaimer, the term of this patent is extended or adjusted under 35 U.S.C. 154(b) by 0 days.

(21) Appl. No.: 15/968,242

(22) Filed: May 1, 2018

(51) Int. Cl.
*A61G 15/00* (2006.01)
*A61G 15/10* (2006.01)
*A47C 3/18* (2006.01)

(52) U.S. Cl.
CPC ..... *A61G 15/10* (2013.01); *A47C 3/18* (2013.01); *A61G 2210/00* (2013.01)

(58) Field of Classification Search
CPC ..... F16M 11/2014
USPC ..... 248/125.7, 131, 349.1; 351/245, 246
See application file for complete search history.

(56) References Cited

U.S. PATENT DOCUMENTS 7,040,248 B1 * 5/2006 Whitfield ..... B63B 29/04 104/45
8,544,809 B1 * 10/2013 Laurita ..... A47C 3/18 248/346.01
2001/0032916 A1 * 10/2001 Wess ..... A61G 5/10 248/349.1
2010/0051774 A1 * 3/2010 Shi ..... F16M 11/10 248/349.1
2011/0127402 A1 * 6/2011 Callahan ..... A61G 3/02 248/678
2013/0100411 A1 * 4/2013 Corrigan ..... A61B 3/0083 351/245
2013/0100412 A1 * 4/2013 Schwaegerle ..... A61B 3/0083 351/245

* cited by examiner

*Primary Examiner* — Steven M Marsh
(74) *Attorney, Agent, or Firm* — Edwin D. Schindler

(57) ABSTRACT

A pivoting examination chair mechanism for an examination chair related to a substantially immovable examination tool, which includes a rotation mechanism portion rotating about a first vertical axis, a rotation arm integral with, and extending from, the rotation mechanism portion, and a chair support portion attached proximate a distal end of the rotation arm and offset from the rotating base portion including a chair gimbal, in which the chair gimbal rotates around a second vertical axis and the first and second vertical axes are substantially parallel to one another, so that moving the rotation arm through 180°, the examination chair is moved about the first vertical axis to provide a clear access area to the substantially immovable examination tool.

4 Claims, 8 Drawing Sheets

PORTABLE EXAMINATION CHAIR

BACKGROUND OF THE INVENTION

Technical Field of the Invention

The present invention relates, generally, to chairs and, more particularly, to a chair that can pivot from a first position to a second position.

More specifically, the present invention provides an examination chair for an optometrist or the like where the chair may pivot out of the way so that a wheelchair may be used during the eye exam.

Description of the Prior Art

It is difficult for a person who is either temporarily or indefinitely confined to a wheelchair to be examined in a doctor's office, especially when examination equipment is mounted such that the medical practitioner has the patient sit in a provided examination chair for the process. This can be especially true in the case of an eye exam where the patient is required to look through various lenses and other diagnostic equipment. The aforementioned examination chair is provided in these offices, however it can be difficult for a wheelchair-bound person to leave the wheelchair and move to the examination chair. The present invention seeks to address the problem by providing a rotating examination chair base that revolves the exam chair into a secondary position so that the wheelchair may be moved to access the exam equipment.

It is thus desirable to provide a pivoting seat mechanism for an examination chair or the like so that a person using a wheelchair can access the examination tools.

It is further desirable to provide a pivoting seat mechanism that smoothly and easily moves out of the way so that the health practitioner may examine the patient without having the person in the wheelchair get up.

SUMMARY OF THE INVENTION

A primary object of the present invention is to provide a pivotable examination chair that allows a person in a wheelchair to be accommodated in an optometrist's office for an eye examination.

Another object of the present invention is to provide a pivotable examination chair that rotates on a ball bearing turning mechanism.

Yet another object of the present invention is to provide a pivotable examination chair that moves from a first, standard position to a second position, leaving a clear space in front of the examination equipment.

Still another object of the present invention is to provide a pivotable examination chair that is located on an arm extending from the ball bearing turning mechanism to move the examination chair in an arc approximating 180 degrees.

Another object of the present invention is to provide a pivotable examination chair that takes up a minimal amount of space for operation.

Yet another object of the present invention is to provide a pivotable examination chair that is convenient for optometrists needing to examine wheelchair bound patients with a phoropter.

Additional objects of the present invention will appear as the description proceeds.

The present invention overcomes the shortcomings of the prior art by providing an examination chair or the like that allows the chair to be moved from a diagnostic equipment operative position (such as an eye exam suite) and into a secondary position that allows a wheelchair occupant to move their chair into the approximate same foot print as the examination chair providing similar operative access to the diagnostic equipment.

More particularly, the present invention provides a pivoting examination chair mechanism for an examination chair related to a substantially immovable examination tool, which includes a rotation mechanism portion rotating about a first vertical axis, a rotation arm integral with, and extending from, the rotation mechanism portion, and a chair support portion attached proximate a distal end of the rotation arm and offset from the rotating base portion including a chair gimbal, wherein the chair gimbal rotates around a second vertical axis and the first and second vertical axes are substantially parallel to one another, thereby moving the rotation arm through 180°, so that the examination chair is moved about the first vertical axis to provide a clear access area to the substantially immovable examination tool.

Other objects and features of the present invention will become apparent when considered in combination with the accompanying drawing figures, which illustrate certain preferred embodiment of the present invention. It should, however, be noted that the accompanying drawing figures are intended to illustrate only select preferred embodiments of the claimed invention and are not intended as a means for defining the limits and scope of the invention.

BRIEF DESCRIPTION OF THE DRAWING FIGURES

In the drawing figures, wherein similar features are denoted with similar reference numerals throughout the several views.

DESCRIPTION OF THE REFERENCED NUMERALS

Figure 1:
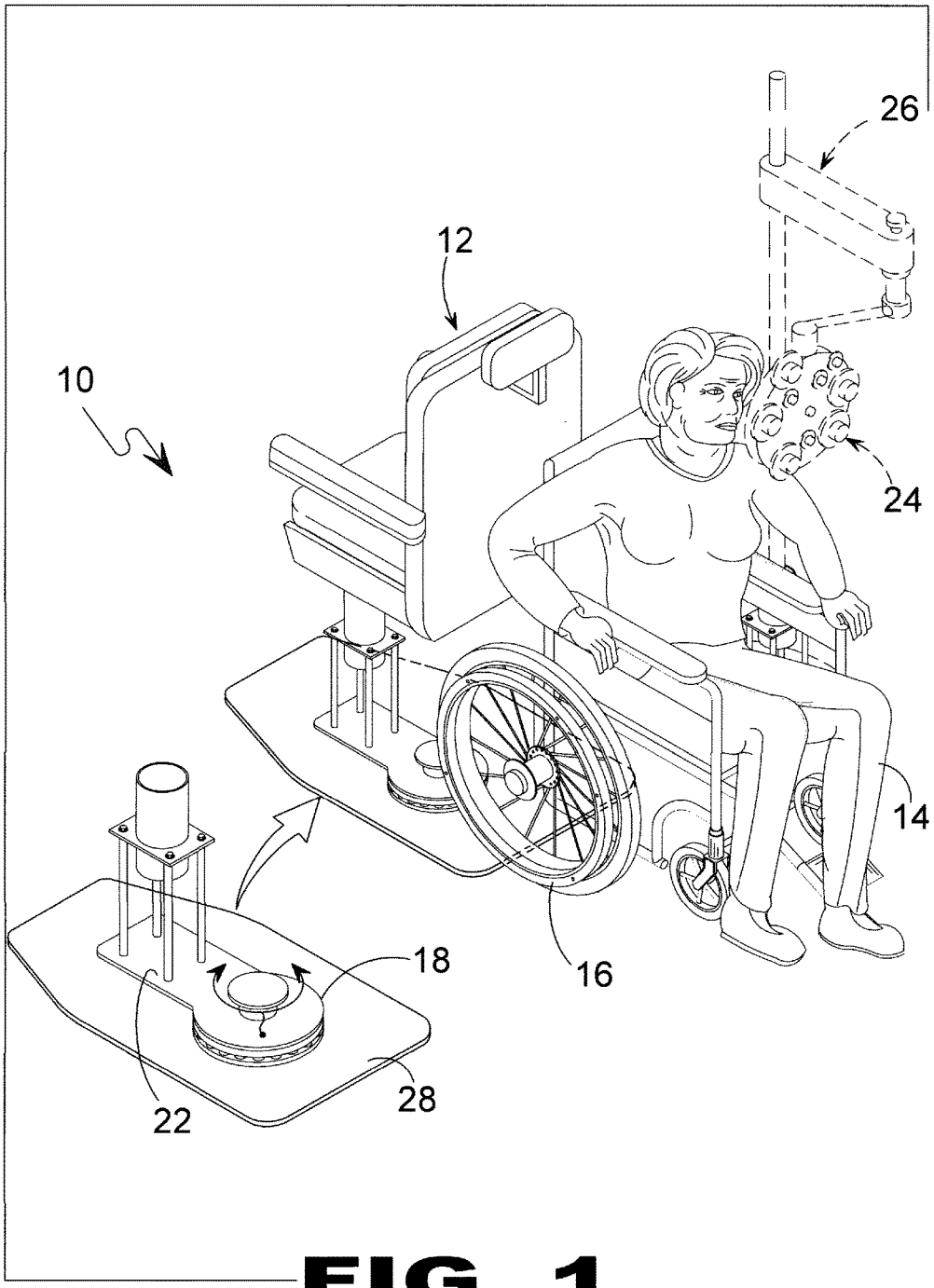
FIG. 1 is an overview of the present invention in use.

Turning now descriptively to the drawings, in which similar reference characters denote similar elements throughout the several views, the figures illustrate the use of the present invention. With regard to the reference numerals used, the following numbering is used throughout the various drawing figures:

10 present invention
12 examination chair
14 user/patient

16 wheelchair
18 ball bearing turning mechanism
22 rotation arm
24 examination tool
26 examination apparatus
28 mat
30 chair support portion
32 legs
34 chair support plate
36 chair gimbal
40 wheelchair space area border
42 wheelchair space
A1 rotation arm path
A2 vertical axis
A rotation arm initial position
B rotation arm interim position
C rotation arm final position

DETAILED DESCRIPTION OF THE DRAWING FIGURES AND PREFERRED EMBODIMENTS

Turning now, in detail, to analysis of the accompanying drawing figures, referring to FIG. 1 the present invention is generally indicated by 10. The user 14 is in wheelchair 16 and the examination chair 12 is seen in the rotated or secondary position. The rotation mechanism is indicated at 18 and the rotation arm 22 being shown. Also seen in FIG. 1 is the examination tool 24 (in this case a phoropter.) This is part of the examination apparatus 26. It should be noted from the outset that though the examination tool 24 in this case is that of an optometrist, many other types of examination equipment could be part of the instant invention.

Figure 2:
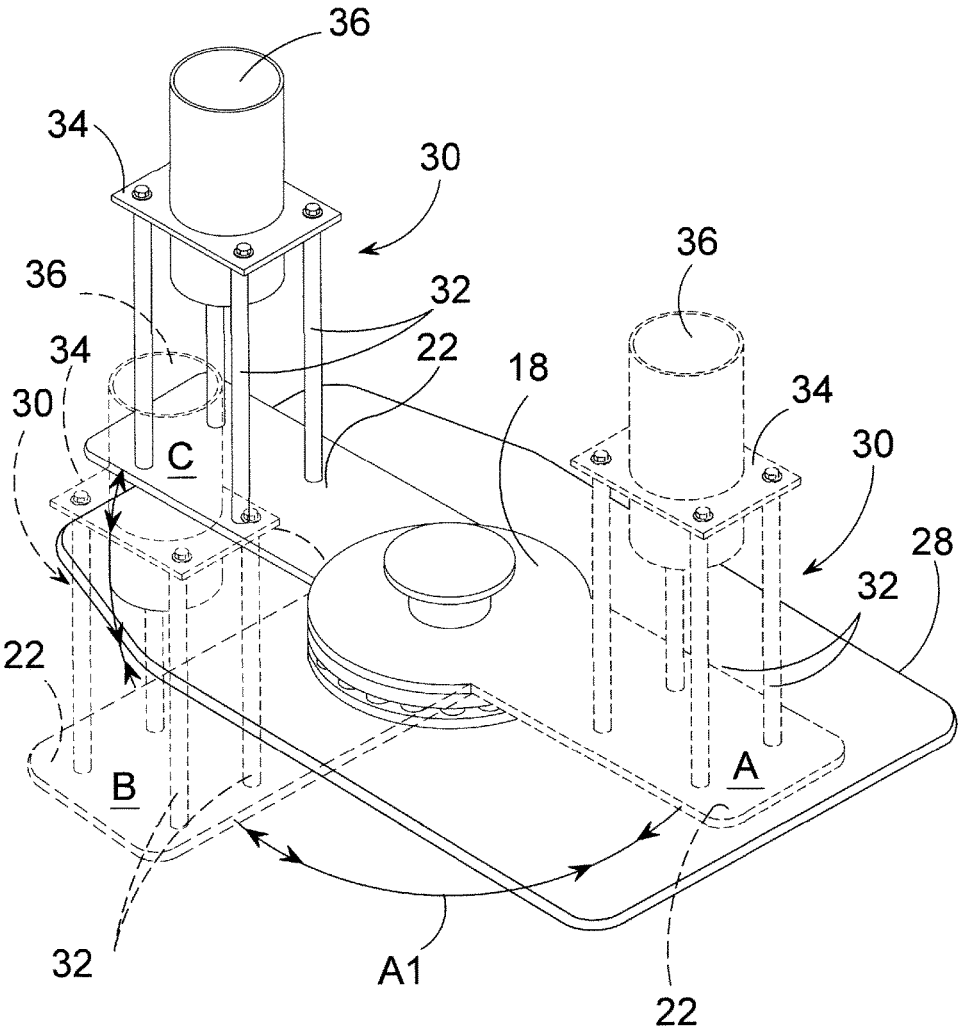
FIG. 2 is a perspective view of the present invention showing the rotation path of the arm on the base.

Turning now to FIG. 2 the movement of the rotation mechanism 18 is shown. The chair support portion 30 is comprised, in the embodiment described herein, of legs 32, chair support plate 34 and chair gimbal 36. The entire support portion 30 is carried by the arm 22 exteriorly depending from ball bearing turning mechanism 18. The initial position of the rotation arm is denoted by A, the interim position of the arm is at B and the final position is at C. The chair though free to move on the gimbal 36 (if the manual safety is unlocked) is carried on top of the chair support portion 30 in the direction indicated by directional arrow A1.

Figure 3:
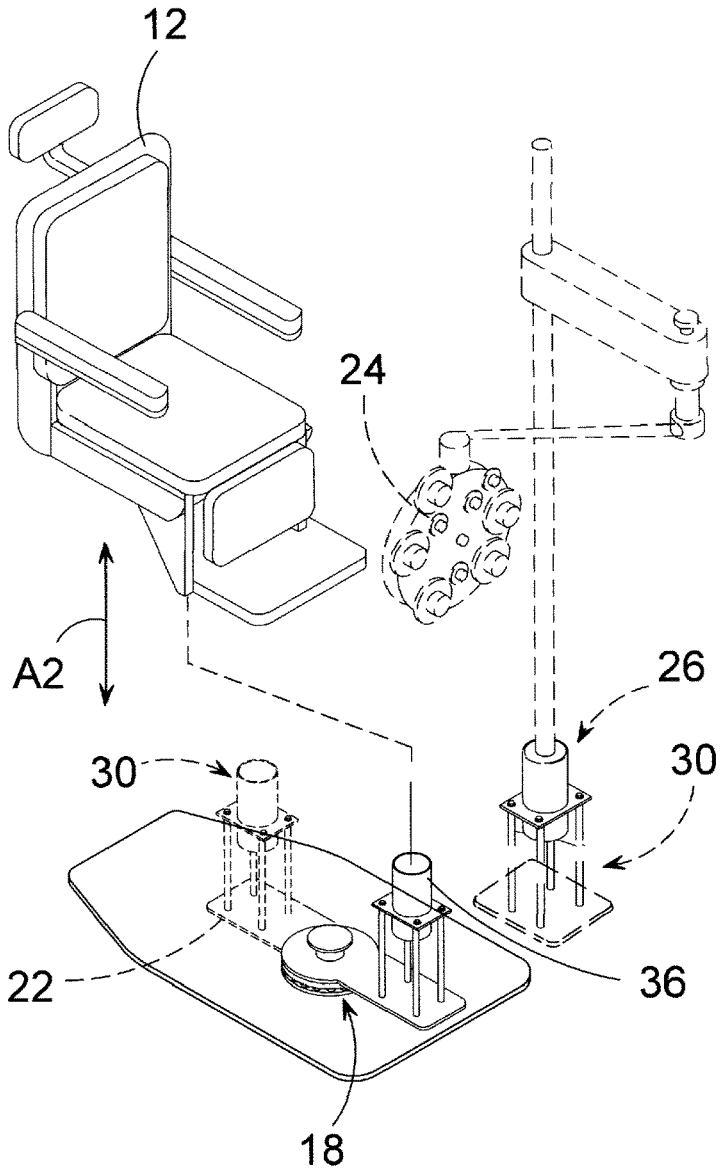
FIG. 3 is a perspective view of the examination chair, examination equipment, and the rotating arm.

FIG. 3 is a partially exploded view with the examination chair 12 being shown apart from the chair gimbal 36. As in FIG. 2, the movement of the rotation mechanism 18 and correspondingly of the rotation arm 22 is depicted at the initial position and the final position (in shadowed lines.) The examination chair's freedom to move is further indicated by directional A2 as many examination chairs have this feature and it could be used to further clear the wheelchair access area, as will be discussed below.

Figure 4:
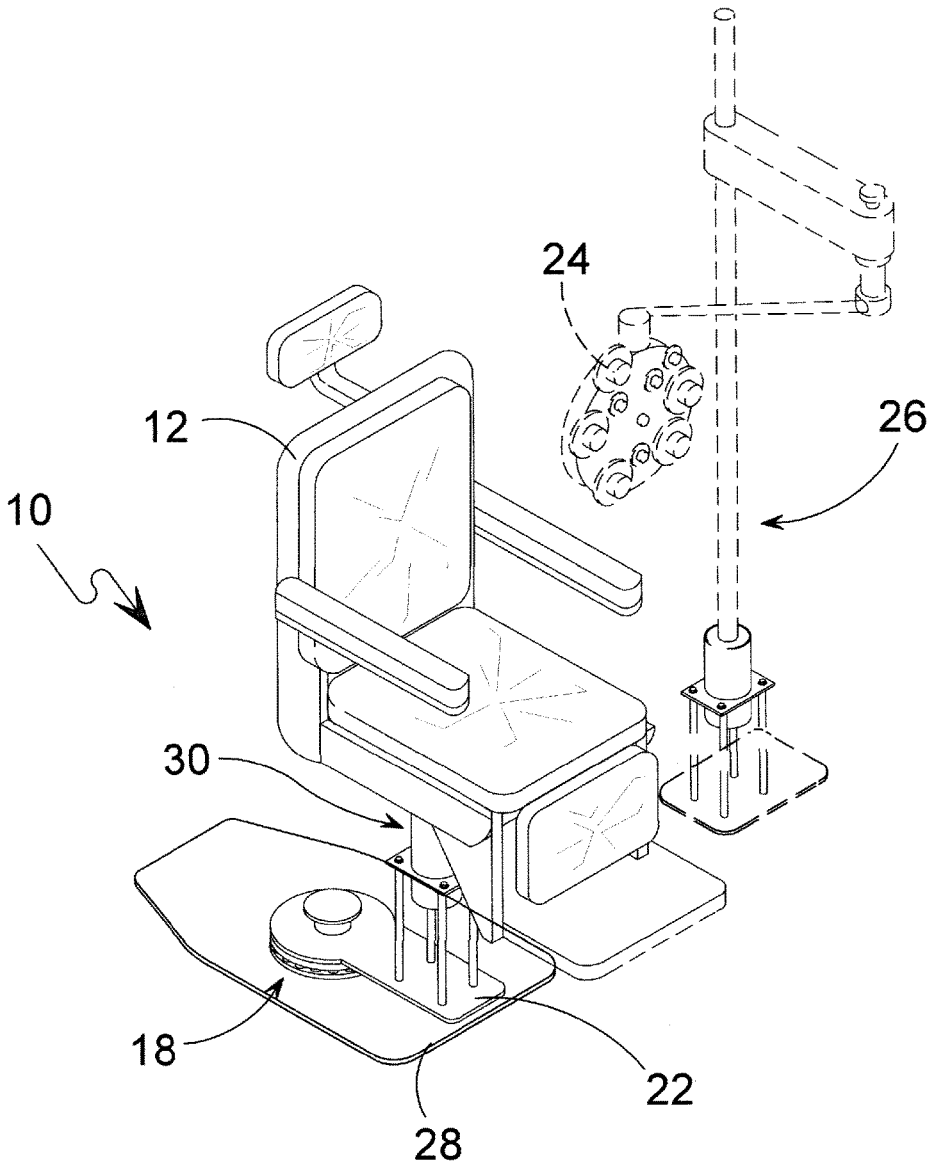
FIG. 4 is a further perspective view of the present invention.

In FIG. 4, we see the present invention 10 when it is not actively being used. The examination chair 12 is in place on gimbal 36 and is positioned such that a patient seated in the chair would be able to use the phoropter (examination tool 24) under an optometrist's guidance.

Figure 5:
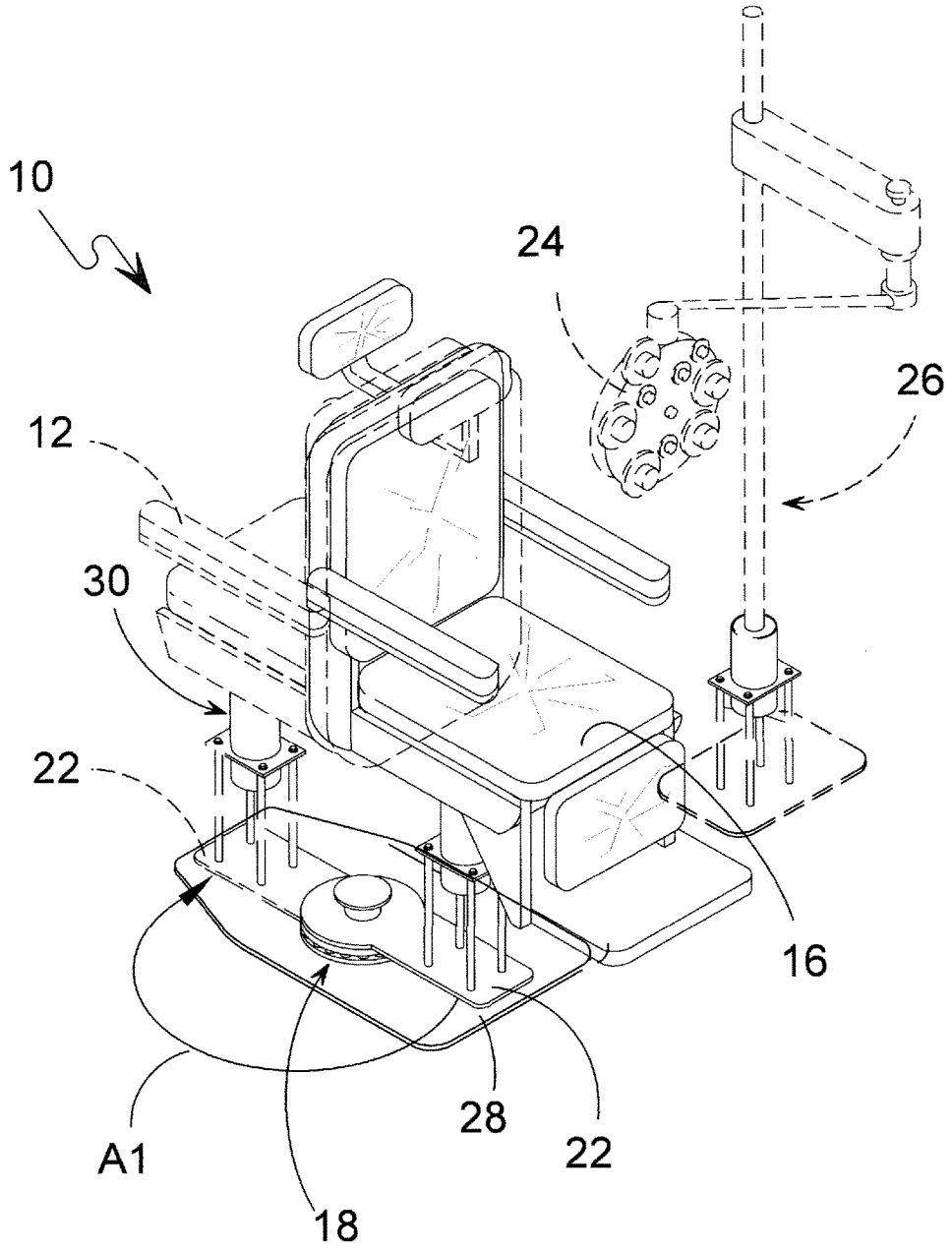
FIG. 5 is a perspective view of the examination chair in both the original and rotated positions.

In FIG. 5, the present invention 10 is shown in the non-active state and, in shadowed lines, in its final position. The movement of the rotation arm 22 is described by directional arrow A1.

Figure 6:
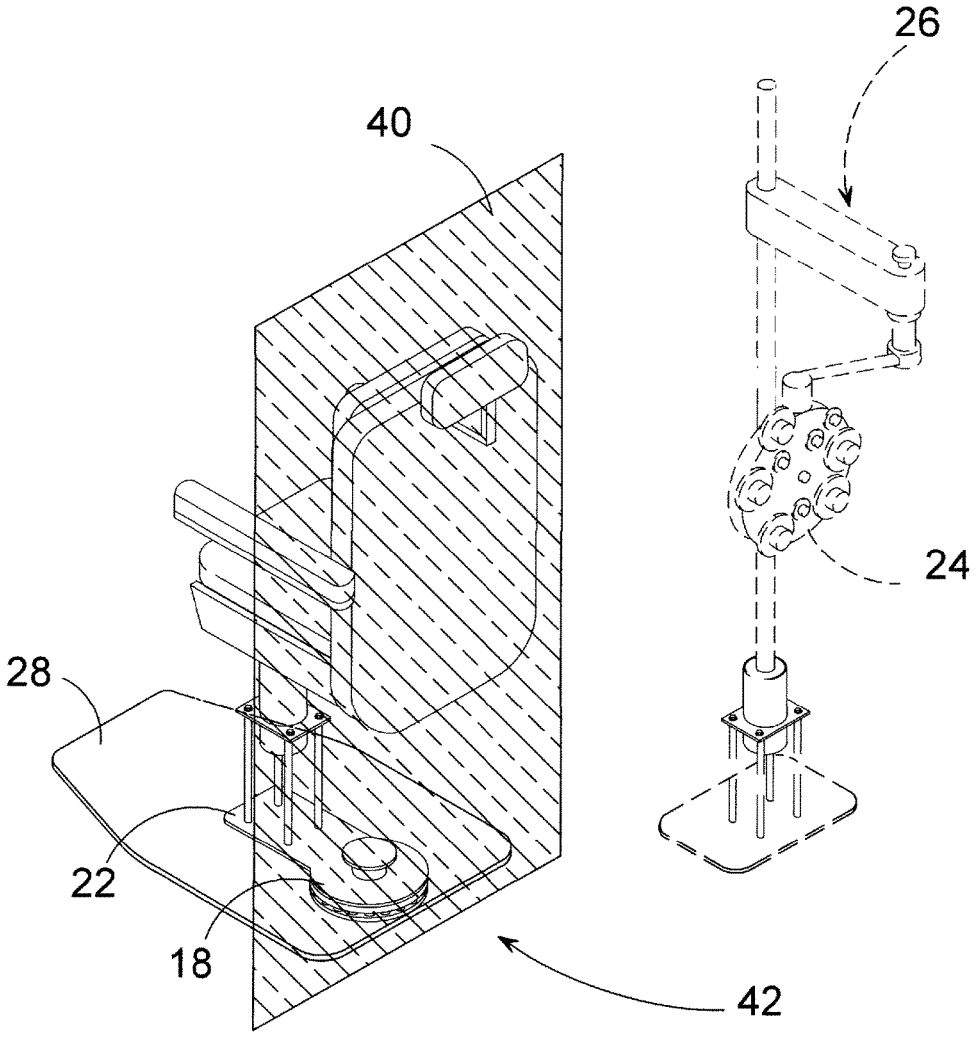
FIG. 6 is a perspective view of the examination chair being rotated out into the second position.

FIG. 6 shows the present invention 10 with the examination chair 12 in the final position after activation. The rotation arm 22 is pointed oppositely to its original direction and the back of examination chair 12 forms part of the wheelchair space area border as is indicated at 40. This additionally created the wheelchair space as shown at 42. The examination tool 26 has been manipulated so that examination tool 24 is also out of the wheelchair area 42.

Figure 7:
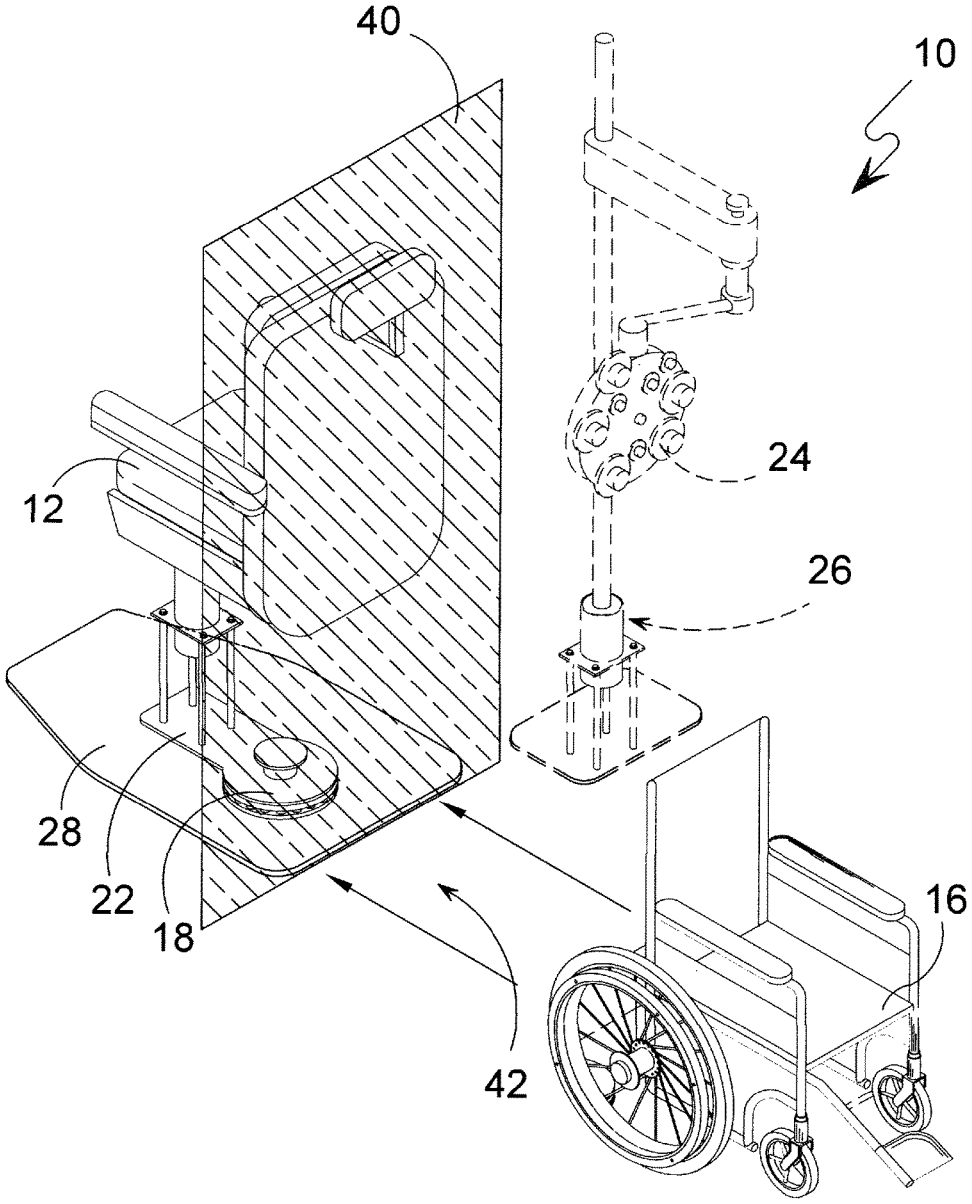
FIG. 7 is a further perspective view of the examination chair being rotated into the second position and the wheelchair being readied to be moved into the examination area; and, FIG. 8 is a perspective view of the present invention with the examination chair rotated into the second position and the wheelchair being located in the examination area.

FIG. 7 shows wheelchair 16 being moved into wheelchair area 42 after the examination chair 12 has been secured in the final position, as indicated at C in FIG. 3.

Figure 8:
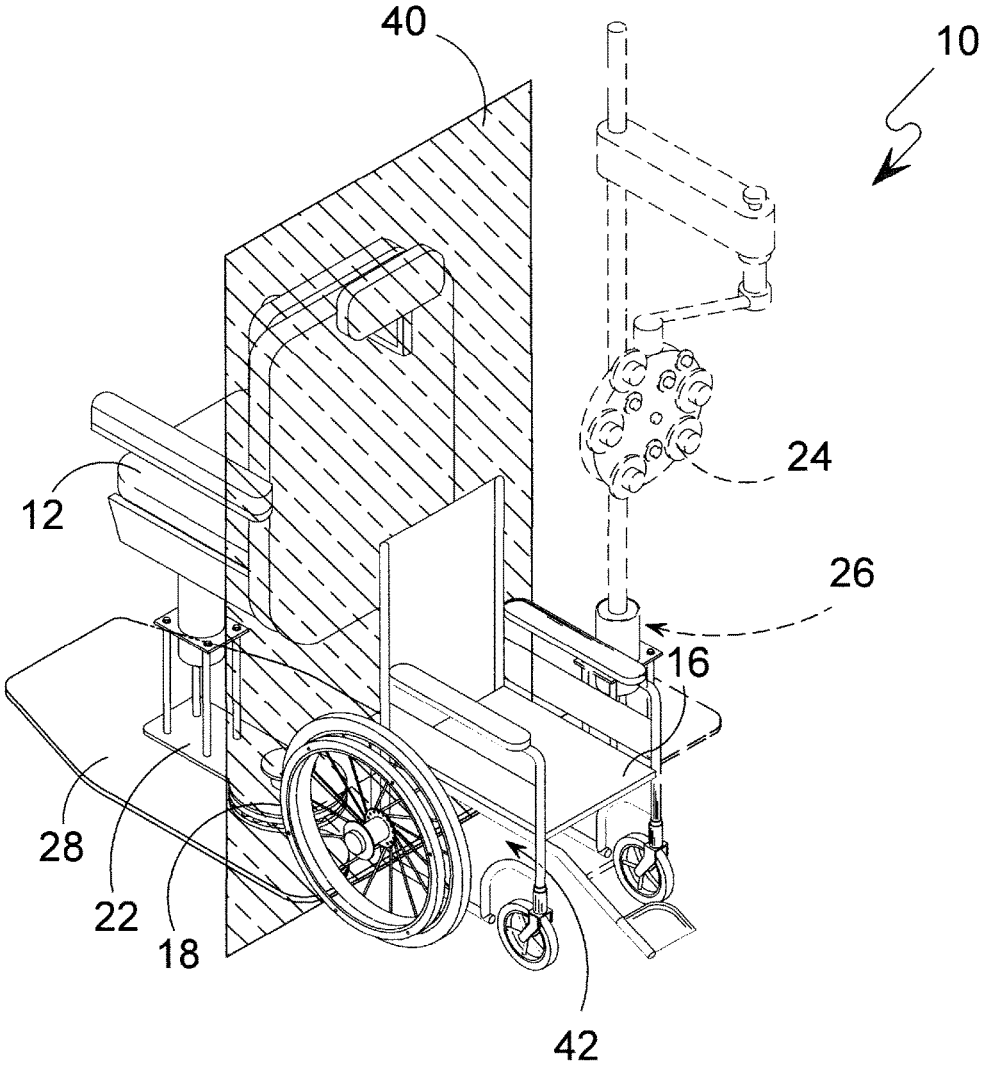

In FIG. 8 the wheelchair 16 is in place in the wheelchair space 42. User 14 is not shown to aid in clarity. The examination tool 24 is ready to be used as necessary and examination chair 12 is completely out of the way.

It should be noted that many types of powered means could be used to activate the present invention. Electric, pneumatic, or even hand power could be used as the motive force. The transmission of the power could be accomplished through chain gear, regular gearing, or various types of drive belts.

While only several embodiments of the present invention have been shown and described, it will be obvious to those skilled in the art that many modifications may be made to the present invention without departing from the spirit and scope thereof.

What is claimed is:

1. A pivoting examination chair mechanism for an examination chair related to a substantially immovable examination tool, comprising:

a rotation mechanism portion rotating about a first vertical axis;

a rotation arm integral with, and extending from, said rotation mechanism portion; and, a chair support portion attached proximate a distal end of said rotation arm offset from a rotating base portion including a chair gimbal located on a set of legs extending upwards from said rotation arm, wherein said chair gimbal rotates around a second vertical axis and wherein said first vertical axis and said second vertical axis are substantially parallel to one another for moving said rotation arm through 180°, so that said pivoting examination chair is movable about said first vertical axis for providing a clear access area to said substantially immovable examination tool.

2. The pivoting examination chair mechanism according to claim 1, wherein said clear access area is of sufficient dimension for a wheelchair.

3. The pivoting examination chair mechanism according to claim 1, wherein said substantially immovable examination tool is a phoropter.

4. A method of accommodating a wheelchair-bound patient in a medical environment including an examination chair and a substantially immovable examination tool, comprising the steps of:

providing a rotation mechanism for said examination chair wherein said rotgation mechanism provides a rotating center with a first axis and a rotation arm extending outward therefrom;

providing a chair platform for said examination chair located on a distal end of said rotation arm such so that, in an inactivated position, said examination chair is located at a distance and attitude sufficient for use in relation to said substantially immovable examination tool; and, providing power to said powered base so that powered base rotates said rotation arm approximately 180°, so that said examination chair is moved out of the distance sufficient for use in relation to said substantially immovable examination tool, thereby creating a space sufficient to accommodate a wheelchair.

* * * * *